US008028665B2

(12) United States Patent
Ralston

(10) Patent No.: US 8,028,665 B2
(45) Date of Patent: Oct. 4, 2011

(54) SELECTIVE COMPOUND ENGINE

(76) Inventor: Mark Dixon Ralston, Long Beach, CA (US)

( * ) Notice: Subject to any disclaimer, the term of this patent is extended or adjusted under 35 U.S.C. 154(b) by 683 days.

(21) Appl. No.: 12/133,366

(22) Filed: Jun. 5, 2008

(65) Prior Publication Data

US 2009/0301086 A1 Dec. 10, 2009

(51) Int. Cl.
*F02B 33/00* (2006.01)
*F02B 25/00* (2006.01)

(52) U.S. Cl. ..... 123/68; 123/70 R; 60/620

(58) Field of Classification Search ..... 123/68, 123/70 R; 60/620
See application file for complete search history.

(56) References Cited

U.S. PATENT DOCUMENTS

| | | | | |
|---|---|---|---|---|
| 3,970,055 | A | 7/1976 | Long | |
| 4,159,700 | A | 7/1979 | McCrum | |
| 4,186,561 | A | 2/1980 | Wishart | |
| 4,237,832 | A * | 12/1980 | Hartig et al. | 123/58.8 |
| 4,250,850 | A * | 2/1981 | Ruyer | 60/620 |
| 4,325,331 | A | 4/1982 | Erickson | |
| 4,401,069 | A | 8/1983 | Foley | |
| 4,917,054 | A | 4/1990 | Schmitz | |
| 5,199,262 | A | 4/1993 | Bell | |
| 5,233,948 | A | 8/1993 | Boggs | |
| 6,202,416 | B1 | 3/2001 | Gray, Jr. | |
| 6,393,841 | B1 | 5/2002 | Van Husen | |
| 6,789,514 | B2 * | 9/2004 | Suh et al. | 123/70 R |
| 7,121,236 | B2 | 10/2006 | Scuderi | |
| 7,260,467 | B2 | 8/2007 | Megli | |

OTHER PUBLICATIONS

A New Cylinder Deactivation by FEV and Mahle, Martin Rebbert, Gerhard Kreusen and Sven Lauer, FEV Motorentechnik GmbH, SAE Technical Paper No. 2008-01-1354, Apr. 14, 2008, SAE Technical Paper No. 2008-01-1354, Apr. 14, 2008, SAE International, 2008 World Congress, Detroit Michigan, USA.

Development of a 6-Cylinder Gasoline Engine with New Variable Cylinder Management Technology, Mikio Fujiwara, Kazuhide Kumagai, Makoto Segawa, Ryuji Sato and Yuchi Tamura, Honda R&D Co. Ltd, SAE Technical Paper No. 2008-01-0610, Apr. 14, 2008, SAE International, 2008 World Congress, Detroit Michigan, USA.

Electro-Magnetic Valve Actuation System: First Steps toward Mass Production, V. Picron, Y.Postel, E. Nicot and D Durrieu, VALEO Engine Management Systems, SAE Technical Paper No. 2008-01-1360, Apr. 14, 2008, SAE International, 2008 World Congress, Detroit Michigan, USA.

Variable Valve Actuation—Switchable and Continuously Variable Valve Lifts, Peter Dreuter, Peter Heuser, Joachim Reincke-Murmann, Rudiger Erz, Ulrich Peter and Oliver Bocker, Meta Motoren-und Engergie-Technik GmbH, SAE Technical Paper No. 2003-01-0026, Copyright 2003, SAE International.

(Continued)

*Primary Examiner* — Noah Kamen

(57) ABSTRACT

The fuel efficiency of an internal combustion reciprocating piston engine may be increased through selective secondary expansion of exhaust gas in the engine cylinders in order to recover exhaust gas energy which is otherwise wasted by cylinder blow-down at the end of the power stroke. Exhaust valve cam switching, intake valve deactivation, multiple exhaust valves, a specialized exhaust manifold arrangement and an exhaust gas diverter valve can be configured to enable a reciprocating engine to selectively operate in efficient eight stroke cycle compound mode when moderate engine power is demanded, then revert to conventional four stroke cycle non-compound mode operation when high engine power is demanded, without stopping the engine. For a road vehicle application, the benefit is substantially reduced highway cruising fuel consumption, while incurring minimal impact on engine weight, minimal impact on engine manufacturing cost, and no adverse impact on vehicle acceleration performance, hill climbing performance or trailer towing performance.

8 Claims, 10 Drawing Sheets

OTHER PUBLICATIONS

Design Optimization of the Piston Compounded Adiabatic Diesel Engine Through Computer Simulation, Dennis N Assanis, Evangelos Karvounis and James A E Bell, SAE Document No. 930986, Mar. 1993, SAE International.

* cited by examiner

VALVE OPEN

VALVE CLOSED

IIIIIIIIIIIIIIII VALVE OPEN

_____ VALVE CLOSED

INT: Intake Valve

EXH: Exhaust Valve

SELECTIVE COMPOUND ENGINE

FEDERALLY SPONSORED RESEARCH

Not Applicable

SEQUENCE LISTING OR PROGRAM

Not Applicable

TECHNICAL FIELD OF THE INVENTION

The present invention improves upon the thermal efficiency of a four stroke cycle internal combustion reciprocating piston engine by means of selectively increasing engine volumetric expansion ratio. This increased engine expansion ratio recovers gas energy which is typically wasted during the engine exhaust stroke when the exhaust valve of a conventional engine opens and excess cylinder gas pressure equalizes with atmospheric pressure in a throttling, or blow-down process. The present invention affects the configuration of a reciprocating piston engine cylinder head, camshaft, combustion chamber valve timing and combustion exhaust gas manifold. The present invention targets any engine application where efficient operation over a variable range of engine power is required, especially those applications where an engine is required to operate at a moderate power output for a large portion of the engine operational duty cycle. The present invention is compatible with turbo-supercharged engines, but is especially beneficial when applied to normally aspirated and mechanically supercharged engines. Suitable applications include, but are not limited to, road and off-road vehicle propulsion engines, marine propulsion engines, auxiliary power unit engines, portable electric power generator engines and stationary electric power generator engines.

BACKGROUND OF THE INVENTION

An internal combustion engine configured to gain thermal efficiency by means of providing a expansion stroke longer than the compression stroke was invented by James Atkinson in 1882, and is known as the Atkinson cycle. In 2002, Toyota Motors employed the Atkinson cycle on their "Prius" gasoline-electric hybrid automobile by configuring the intake valve timing for late valve closure during the compression stroke. A disadvantage of the Atkinson cycle approach to enhance expansion ratio is that engine volumetric efficiency is reduced by the reduction in combustion chamber charge volume, which increases the weight per unit horsepower of the engine. For a vehicle application, the resultant increased engine weight leads to an increase in overall vehicle weight, which detracts from the goal of reducing overall vehicle fuel consumption. The present invention avoids this weight disadvantage by providing a means to selectively engage compound mode operation to increase expansion ratio, without affecting maximum engine power capacity when compound operating mode is de-selected.

The Curtiss Wright R-3350 turbo-compound radial airplane engine of the 1950's recovers exhaust gas energy, which would otherwise be wasted, by means of multiple power recovery turbines coupled through gearboxes to the engine output shaft. This solution minimizes the weight penalty of adding exhaust gas expansion cylinders, however the high cost of the power recovery turbines and their associated gearboxes has since precluded application of the power recovery turbine method for non-aviation use. The present invention avoids this turbine and gearbox cost penalty by configuring the engine's own cylinders to act as selective power recovery expansion cylinders.

The method of improving the efficiency of a piston engine through compounding by utilizing a second cylinder to further expand working gas exhausted from a first cylinder has been widely applied to piston steam engines since the early nineteenth century. This same well known multiple cylinder compounding principle is applicable to internal combustion engines.

U.S. Pat. Nos. 6,202,416 Gray, 5,199,262 Bell, 4,917,054 Schmitz, 4,250,850 Ruyer, 4,237,832 Hartig and 4,159,700 McCrum, describe multiple cylinder compounding applied to an internal combustion piston engine, similar to the principle traditionally employed for compounded steam engines, by dedicating some of the engine's cylinders as exhaust gas secondary expansion cylinders, and describe valve timing and cylinder motion timing methods to effect the transfer of exhaust gas from fuel burning fired cylinders to secondary expansion cylinders. The Bell patent also describes a separate crankshaft for the expansion cylinders, driven at twice crankshaft speed, for the purpose of reducing the required size of the expansion cylinders, reducing the weight penalty of the expansion cylinders as compared to the McCrum, Schmitz and Gray patents. However, even with the reduced expansion cylinder size, the addition of dedicated expansion cylinders according to these prior patents adds significant weight and bulk to the engine, which is counterproductive to the goal of reducing vehicle fuel consumption. The present invention differs from the Gray, Bell, Schmitz and McCrum patents in that, according to the present invention, the expansion cylinder can selectively change back and forth, while the engine is running, from functioning as an expansion cylinder to functioning as a conventional fired cylinder, whereas, according to the Gray, Bell, Schmitz and McCrum patents, the function of the expansion cylinders is fixed, such that they are unable to function as conventional fired cylinders.

In addition, the present invention provides a means to store a compressed charge of exhaust gas in an exhaust gas expansion chamber and an exhaust manifold until any such time as the expansion cylinder is ready to accept it, whereas, according to the Gray, Bell, Schmitz, Ruyer and McCrum patents, the stroke timing of the power and expansion cylinder pistons must be constrained to a specific relative crankshaft clocking angle in order to facilitate the transfer of the exhaust gas charge from the fired cylinder to the expansion cylinder.

The present invention requires at least two conventional poppet type exhaust valves in each expansion cylinder head, similar to the Hartig patent and similar to one variant of the Ruyer patent. However, in the case of these Hartig and Ruyer patents, one of the exhaust valves in each cylinder only functions when compound mode operation is selected and remains closed when all cylinders are firing. With an inactive valve occupying part of the cylinder head, there is less port area available for the functioning valves, which constrains port size, thereby detracting from volumetric efficiency and increasing engine specific weight. The present invention retains use of all the exhaust valves when all the cylinders are firing, thereby imposing no penalty on maximum power capacity.

U.S. Pat. Nos. 7,121,236 Scuderi and 6,789,514 Suh describe a split cycle engine configuration in which intake and compression takes place in a dedicated cylinder, then the compressed gas charge is transferred to a second fired cylinder in which the charge is burned, expanded and exhausted. Such a split cycle engine may be configured with a charge cylinder having smaller volumetric displacement than the combustion cylinder, thereby increasing expansion ratio and improving thermal efficiency. However, such a split cycle cylinder configuration incurs the same overall engine weight penalty as does the Atkinson cycle configuration because of the consequent reduction of total engine volumetric efficiency. The present invention differs from the Scuderi and Suh patents in that, according to the present invention, the expansion cylinder is not used for combustion while compound operating mode is selected, rather it is used for secondary expansion of completely burned combustion products gas provided by a separate fuel burning fired cylinder.

Cylinder deactivation is a known method of improving the efficiency of a spark ignition engine operating at moderate power output, as further described by U.S. Pat. No. 7,260,467, Megli, and SAE Technical Paper Jan. 26, 2003. General motors applied cylinder deactivation to production Cadillac car engines in 1981. With this known method, dis-engageable couplings of conventional design are provided as part of the valve train for some of the cylinders, which when selected, de-couple the affected valves from their respective valve drive cams, causing the affected valves to remain closed, thus preventing fresh charge air from entering or leaving the deactivated cylinders. Fuel to the deactivated cylinders is shut off by an automatic controller. In the traditional method, the deactivated cylinders repeatedly compress and expand a trapped air charge within the cylinder. The remaining engine cylinders function normally as fired cylinders. A consequent reduction in total air flow to the engine allows the intake throttle valve to be opened wider to maintain the same moderate amount of power output. The resulting reduction in charge air pressure drop across the throttle valve eliminates some of the charge air throttling losses, resulting in an estimated five to ten percent increase in part-power engine efficiency for this cylinder deactivation method, with no adverse affect on the engine's maximum power rating. Similar disengageable valve drive cam couplings comprise components of the present invention, and the present invention also gains efficiency benefits from reduced throttling losses, however, the present invention differs from the cylinder deactivation method in that the affected cylinder or cylinders do not function as deactivated cylinders, instead these cylinders actively expand combusted gas discharged from one or more fired cylinders.

U.S. Pat. No. 4,401,069, Foley, describes an improvement on the cylinder deactivation principle in which an axially moving camshaft can selectively shift between two cam profiles for each valve, without stopping the engine. Similar cam profile selectivity comprises a part of the present invention, however, like the Megli patent, the Foley patent facilitates only cylinder deactivation, whereas the present invention utilizes selective cam profile changing in order to facilitate the active expansion of combusted gas discharged from one or more power cylinders.

Individual working elements comprising the present invention may appear conventional, however, in the present invention these working elements combine according to a new operating principle which has not been contemplated in the prior art.

Notwithstanding the numerous prior systems contemplated for addressing efficiency losses associated with the conventional four stroke cycle engine, and in light of the increasing cost and scarcity of petroleum based motor fuel, there remains a need for a simple, low cost, and light weight method for recovering otherwise wasted exhaust gas energy during moderate engine power operation, without adversely affecting the engine's maximum power rating.

SUMMARY OF THE INVENTION

These and other needs are provided, according to the present invention, by an apparatus that is readily adaptable to any four stroke cycle internal combustion engine, whether a spark ignition engine, a compression ignition engine or a hybrid of the two, such as a homogeneous charge compression ignition engine.

Owing to the kinematics of the crankshaft and connecting rod mechanism serving to reciprocate the piston within the cylinder, the volumetric expansion ratio of a conventional normally aspirated engine is typically equal to the engine volumetric compression ratio. In the case of a compression ignition engine, the compression ratio is typically limited by the maximum peak combustion gas temperature and pressure that the cylinder can tolerate. In the case of a spark ignition engine, the compression ratio is typically limited by the need to avoid detonation of the fuel. Consequently, per conventional design practice, engine volumetric expansion ratio is a fixed parameter which cannot be altered without altering other functional aspects of the engine. The present invention implements a method to vary the volumetric expansion ratio of an engine while it is running, thereby optimizing either the fuel efficiency or the horsepower capacity, according to the amount of power being demanded from the engine.

An engine operating according to the present invention has two operating modes, compound mode selected and compound mode de-selected. When, as a result of high power demand on the engine, compound mode is de-selected, all cylinders function as power cylinders and the engine operates as a conventional four stroke cycle engine with normal volumetric efficiency and unrestricted power capacity, whereby exhaust gas discharges from each cylinder at the end of the power stroke directly to the exhaust collector conduit and overboard. When, as a result of moderate power demand on the engine, compound mode is selected, the function of one or more cylinders changes from that of power cylinder to that of expansion cylinder. This change is accomplished by changing the timing of the expansion cylinder valves and by diverting the flow path of exhaust gas after it discharges from the power cylinder. Exhaust gas displaced from the power cylinder passes through a pressurized exhaust manifold to the expansion cylinder where additional work is extracted from the exhaust gas before it is discharged to the exhaust gas collector conduit. When two expansion cylinder expansion strokes are completed for each power cylinder power stroke, engine expansion ratio is doubled and engine fuel efficiency is consequently increased.

When a mechanical supercharger is added to an engine to improve power capacity, normal practice is to reduce cylinder compression ratio to compensate for the increased temperature of the charge air produced by the supercharger so that charge detonation may be avoided at open throttle operation. An unavoidable effect of reducing compression ratio is a corresponding reduction of expansion ratio, which in turn increases combustion gas work losses at cylinder blow-down. Since the present invention effectively doubles cylinder expansion ratio, it is especially advantageous when applied to a supercharged engine. The present invention may also be applied to a turbo-supercharged engine, however, in this case, one preferred embodiment would utilize an exhaust gas waste gate valve to bypass the turbocharger turbine when compound mode is selected, so that exhaust gas may fully expand in the expansion cylinder without being subjected to back pressure from the turbocharger turbine.

Cylinder heads comprising four valves per cylinder and overhead camshafts are commonly used on currently manufactured engines. The present invention utilizes at least two exhaust valves at each expansion cylinder, which makes the present invention readily adaptable to currently manufactured engines.

When an engine operates according to the present invention with compound mode selected, exhaust gas flows through one expansion cylinder exhaust port at a time, instead of through both exhaust ports simultaneously, as is the case with compound mode de-selected. Although this results in a constriction of the total port area through which the exhaust gas must flow, there is no consequent deleterious effect on compound mode operation owing to this constriction. This is because compound mode is typically selected when only moderate power is required and the engine can operate at moderate speed. Consequently, the mass flow rate of exhaust gas moving through an individual cylinder port with compound mode selected at moderate speed is typically no greater than the mass flow rate of gas moving through each cylinder port when compound mode is de-selected, the engine is operating at high speed, and gas is flowing through both cylinder exhaust ports simultaneously.

Another benefit derived by the invention is reduced nitrogen oxide gas emission from the engine cylinders on engines equipped with direct fuel injection. By retarding the timing of the fuel injection event, peak combustion temperatures can be reduced, which ordinarily will adversely affect fuel consumption due to the loss of cylinder pressure over the power stroke, however, the present invention increases the overall expansion ratio, thus offsetting this loss of efficiency. In addition, the elapsed time duration of the overall expansion interval is extended, thus providing more time for the combustion process to be completed.

Still another benefit of the invention, as compared to conventional cylinder deactivation, is that cylinder and cylinder head temperatures are maintained at normal levels while compound mode is selected, whereas, when conventional cylinder de-activation is used, the cylinder and cylinder head tends to cool, which then can then lead to a period of increased cylinder gas emissions after the cylinder is re-activated, until the cylinder and cylinder head recover stable operating temperature.

LIST OF THE DRAWING REFERENCE NUMERALS

5 Power Cylinder
5*a* First Power Cylinder, Four Cylinder Engine
5*b* Second Power Cylinder, Four Cylinder Engine
5*c* Third Power Cylinder, Four Cylinder Engine
6 Power Cylinder Intake Valve Cam
7 Power Cylinder Exhaust Valve Cam
8 Fixed Cam Coupling
9 Intake Manifold
10 Throttle Valve
11 Crankshaft Connecting Rod Journal
12 Piston
13 Intake Port Fuel Injector
14 Expansion Cylinder
14*a* First Expansion Cylinder, Four Cylinder Engine
14*b* Second Expansion Cylinder, Four Cylinder Engine
15 Dis-engageable Cam Coupling
16 Lever Arm Type Cam Follower
17 Expansion Cylinder Intake Valve
18 Inner Plunger
19 Outer Cylinder
20 Compression Spring
21 Pin Segment
22 Hydraulic Piston
23 Solenoid Valve
24 Oil Distribution Manifold
25 Expansion Cylinder Intake Valve Cam
26 Expansion Cylinder First Exhaust Valve
27 Expansion Cylinder Second Exhaust Valve
28 Expansion Cylinder First Exhaust Cam
29 Expansion Cylinder Second Exhaust Cam
30 Expansion Cylinder Third Exhaust Cam
31 Expansion Cylinder Fourth Exhaust Cam
32 Exhaust Manifold
33 Power Cylinder Exhaust Port
34 Expansion Cylinder First Exhaust Port
35 Exhaust Gas Reservoir Chamber
36 Diverter Valve
37 Exhaust Collector Manifold
38 Cross Pin Spring
39 Intake Valve Camshaft
40 Exhaust Valve Camshaft
41 Lubricating Oil Port
42 Power Cylinder Intake Valve
43 Valve Actuator

DETAILED DESCRIPTION OF THE PREFERRED EMBODIMENTS

The present invention will now be described more fully hereinafter with references to the accompanying drawings, in which preferred embodiments of the invention are shown. This invention may, however, be embodied in many different forms and should not be construed as limited to the embodiments set fourth herein; rather, these embodiments are provided so that this disclosure will be thorough and complete and will fully convey the scope of the invention to those skilled in the art. Like numbers refer to like elements throughout.

Figure 1:
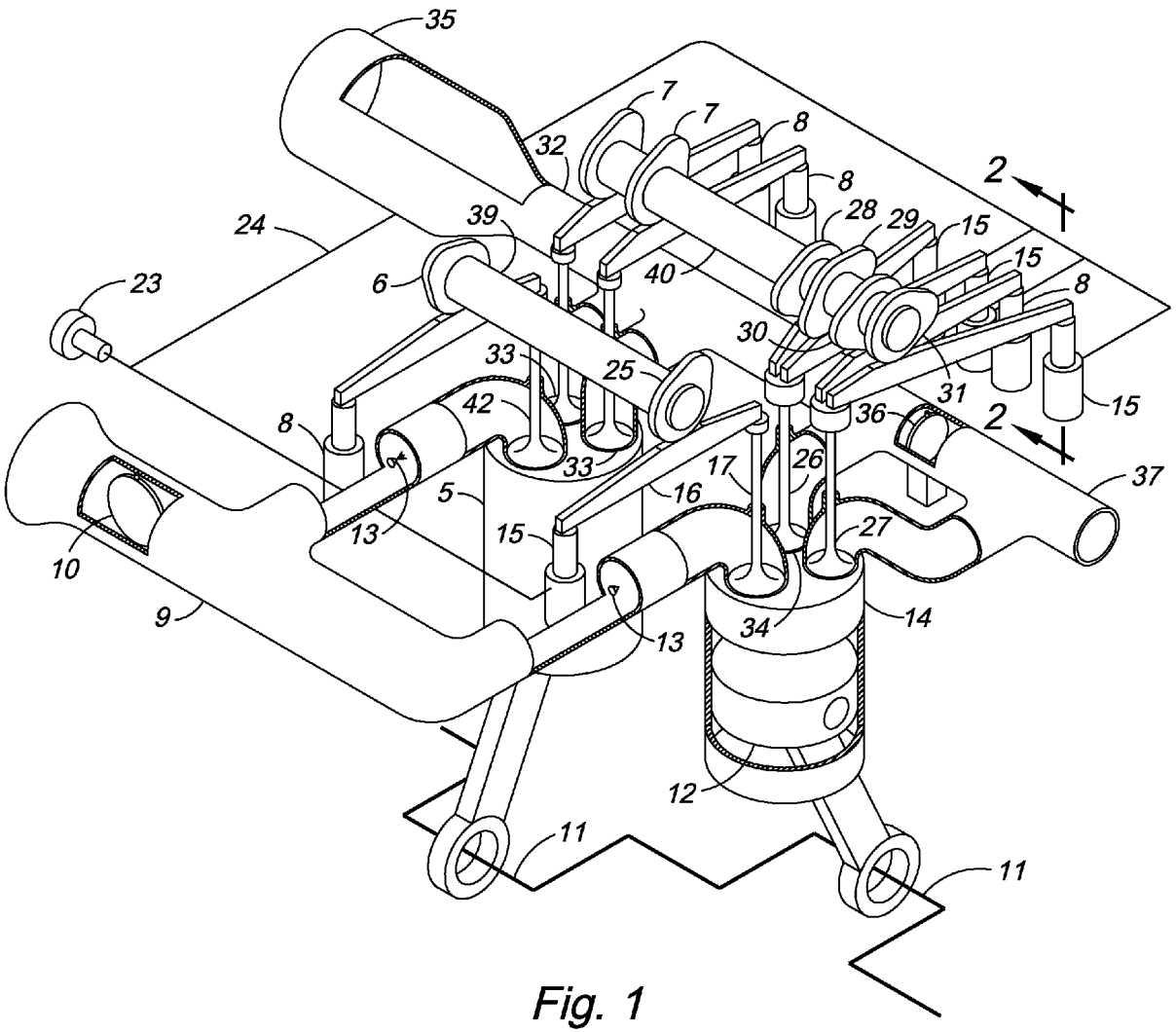
FIG. 1 is a comprehensive isometric view of all relevant elements of a two cylinder embodiment of the invention.

Turning now to FIG. 1, power cylinder 5 has an intake valve cam 6 and exhaust valve cams 7, and fixed couplings 8 between the cams and the valves. The engine has a conventional intake manifold 9 and intake throttle valve 10. Per conventional practice, the crankshaft connecting rod journals 11 are clocked 180 degrees from each other such that when one piston 12 is at top dead center, the other piston is at bottom dead center. FIG. 1 shows individual intake port fuel injectors 13, but a conventional carburetor, a throttle body fuel injector, or fuel injection directly into the cylinder can also be used.

FIG. 1 shows that the engine has an intake valve camshaft 39 and an exhaust valve camshaft 40, which rotate in a conventional manner through mechanical coupling to the crankshaft 11. The expansion cylinder 14, has a single dis-engageable coupling 15 for the intake valve 17, functionally similar to that used on engines configured for conventional cylinder deactivation. FIG. 1 depicts a lever type cam follower 16 situated between the intake valve stem 17 and the dis-engageable coupling 15. However, there are many other known serviceable methods for implementing a dis-engageable coupling, depending on the configuration of a particular valve train mechanism, that are compatible with the present invention. For example, a dis-engageable coupling may be located on the cam follower lever itself, may be located between the valve stem and the cam or cam follower, or may be built into the tappet of a pushrod and rocker arm actuated overhead valve mechanism.

Figure 2:
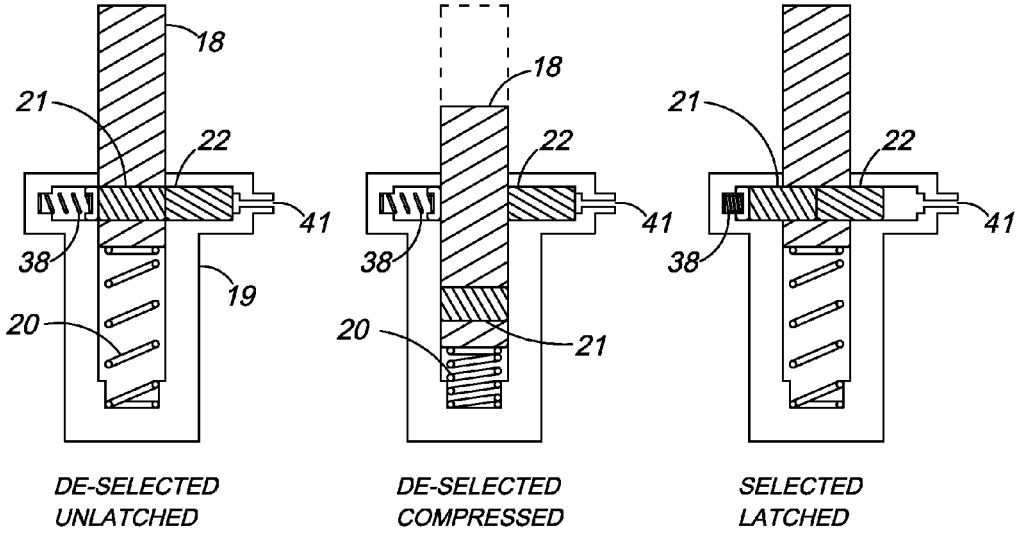
FIG. 2 is a detail view from FIG. 1, comprising one element of the invention, showing functional elements of a first type of dis-engageable drive cam coupling, which, when selected, latches the coupling to the engaged position.

FIG. 2 is a cross section view of a dis-engageable coupling 15 taken from FIG. 1, illustrating functional elements of one type of conventional dis-engageable coupling which is compatible with the subject invention. Per conventional practice, the dis-engageable coupling can be combined with a hydraulic valve lash adjuster into a single cylindrical unit. As shown by FIG. 2, the coupling has an inner plunger 18 which can slide axially within an outer cylinder 19. A compression spring 20 positioned between the inner plunger 18 and outer cylinder 19 extends the total height of the dis-engageable coupling assembly. A two piece cross pin, comprised of pin segment 21 and piston 22, engages holes drilled crosswise through the inner plunger 18 and outer cylinder 19. As shown on FIG. 2, when the coupling is selected, engine lubricating oil enters port 41, exerts hydraulic pressure on piston 22, and moves piston 22 and pin segment 21 to fully compress cross pin spring 38 so as to place the coupling in the selected, latched position, thereby preventing the dis-engageable coupling assembly from being compressed such that, as shown on FIG. 1, the second exhaust valve cam 31 can depress the second exhaust valve stem 27 by depressing the lever arm cam follower 16. When the coupling is de-selected, there is an absence of lubricating oil hydraulic pressure at port 41, consequently, cross pin spring 38 extends so as to move pin segment 21 and piston 22 to the de-selected, unlatched position. In this unlatched position, the ends of pin segment 21 align with the edges of the inner plunger 18 such that the coupling can absorb the motion of the second exhaust valve cam through compression of the inner plunger 18, together with the pin segment 21, against the compression spring 20. The valve stem return spring is stronger than the compression spring 20, resulting in the cam stroke being accommodated by compression of the coupling spring instead of by the valve stem spring, whereby the engine valve remains closed.

Figure 3:
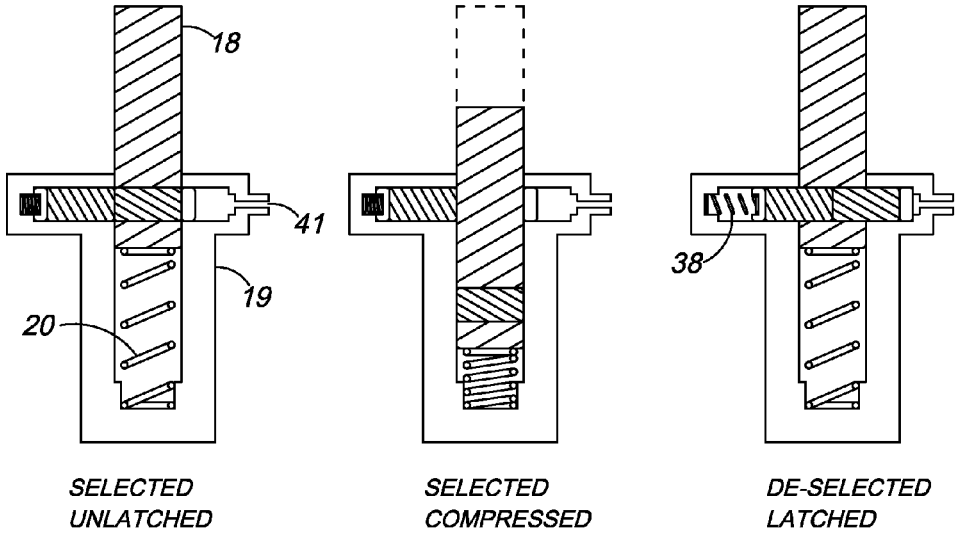
FIG. 3 is a detail view, similar to FIG. 2, showing functional elements of a second type of dis-engageable drive cam coupling, which, when selected, un-latches the coupling to the dis-engaged position.

FIG. 3 shows an alternate configuration of a dis-engageable coupling, which utilizes similar components to that shown in FIG. 2, but instead of becoming latched when engine oil hydraulic pressure is applied to port 41, the coupling becomes unlatched when engine oil hydraulic pressure is applied.

Accordingly, there are two types of hydraulic dis-engageable coupling applied to the subject invention. One type engages the latch as a result of hydraulic pressure, as shown by FIG. 2. The other type dis-engages the latch as a result of hydraulic pressure, as shown by FIG. 3. The present invention in this example utilizes both of these coupling types, depending on whether or not a particular cam is active or inactive during compound mode operation. As shown by FIG. 1, this permits a single hydraulic oil distribution manifold 24 to serve all of the dis-engageable couplings 15, such that, when a single solenoid operated valve 23 opens to apply hydraulic pressure to the oil distribution manifold 24, all coupling pin segment 21 and piston 22 latches move to place all four dis-engageable couplings 15 into the compound operating mode position; and when the solenoid operated valve 23 closes to shut off hydraulic pressure, the cross pin compression springs 20 then move all the cross pin segment 21 and piston 22 latches to place all four dis-engageable couplings 15 into the non-compound position. This example describes use of a hydraulic piston 22 to move a latching pin, however, an electro-mechanical device such as a solenoid or motor may be used in place of a hydraulic piston to achieve the same latching and un-latching effect on a dis-engageable coupling.

Referring now back to FIG. 1, when compound operating mode is selected, dis-engageable coupling 15 decouples an expansion cylinder intake valve 17 from an intake valve cam 25, whereby the intake valve 17 remains closed. The expansion cylinder has a first exhaust valve 26 and a second exhaust valve 27. The first exhaust valve 26 opens according to the position of either first exhaust cam 28 or second exhaust cam 29. First exhaust cam 28 and second exhaust cam 29 each have a dis-engageable coupling 15 between the cams and the first exhaust valve 26, to enable the opening sequence of the first exhaust valve 26 to be switched between that of first exhaust cam 28 and second exhaust cam 29. When compound operating mode is selected, the first exhaust valve 26 couples with second exhaust valve cam 29. When compound operating mode is de-selected, the first exhaust valve 26 couples with first exhaust cam 28. The second exhaust valve 27 opens according to the position of third exhaust cam 30 and fourth exhaust cam 31. Only fourth exhaust cam 31 requires a dis-engageable coupling linking it to the second exhaust valve 27. When compound operating mode is selected, the second exhaust valve 27 couples with third exhaust cam 30 and fourth exhaust cam 31 simultaneously. When compound operating mode is de-selected, the second exhaust valve 27 couples only with third exhaust cam 30.

As shown by FIG. 1, exhaust manifold 32 connects power cylinder exhaust ports 33 with the expansion cylinder first exhaust valve 26 port. Reservoir chamber 35 adds gas storage volume to the exhaust manifold 32. This additional gas storage volume moderates the variation of gas pressure in the exhaust manifold 32 as the exhaust manifold 32 receives and expels individual charges of exhaust gas. If the engine is configured such that the exhaust manifold 32 by itself has sufficient volume, an exhaust gas reservoir chamber 35 is not required. When compound operating mode is selected, diverter valve 36 closes to prevent power cylinder 5 exhaust gas from escaping through the exhaust collector manifold 37.

When compound mode is de-selected, diverter valve 36 opens to allow free flow of exhaust gas from the exhaust manifold 32 to the exhaust collector manifold 37.

Figure 4:
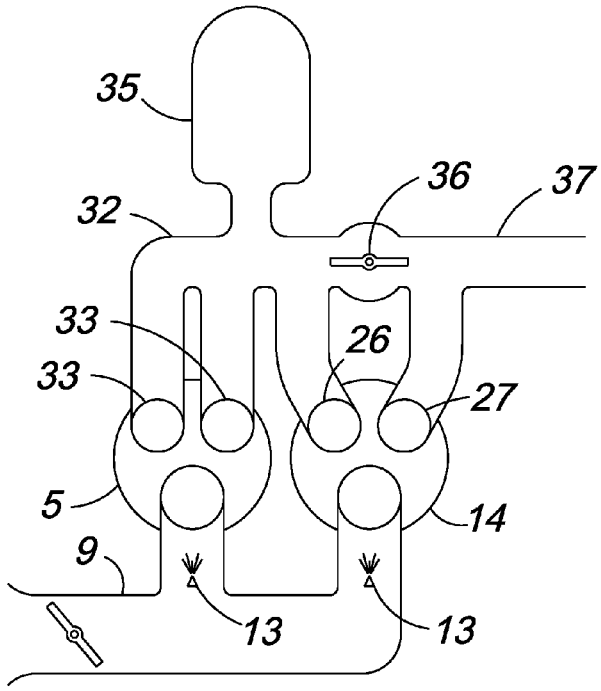
FIG. 4 is a plan view of a two cylinder embodiment operating with compound mode de-selected.

FIG. 4 is a plan view showing gas flow through the two cylinder engine embodiment when compound operating mode is de-selected. Fuel and charge air are admitted to both cylinders, 5 and 14. The exhaust diverter valve 36 remains open. Exhaust gas discharges freely from the ports of all four exhaust valves 33, 26 and 27, into the exhaust manifold 32 and the exhaust collector manifold 37, and from there to the atmosphere. Valve timing for the expansion cylinder 14 operates according to the conventional four stroke cycle, thus enabling both cylinders to produce maximum power according to the conventional four stroke cycle.

Figure 5:
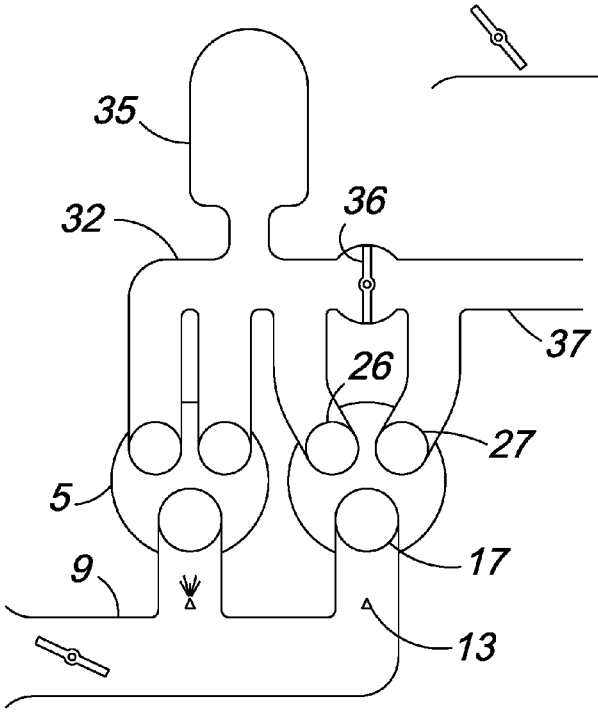
FIG. 5 is a plan view of a two cylinder embodiment operating with compound mode selected.

FIG. 5 is a plan view showing gas flow through the two cylinder engine embodiment when compound operating mode is selected. Charge air flows from the intake manifold 9 into the power cylinder 5 only. Fuel flow from the expansion cylinder injector 13 is shut off. The expansion cylinder intake valve 17 remains closed, preventing any fresh charge flow into the expansion cylinder 14. Exhaust gas discharged from the power cylinder 5 flows through the exhaust manifold 32 and then into the expansion cylinder 14 through the port of the first exhaust valve 26. Excess exhaust gas is stored temporarily in the reservoir 35. Fully expanded exhaust gas discharges into the exhaust collector manifold 37 through the port of the second exhaust valve 27. The diverter valve 36 is closed to prevent gas in the exhaust manifold 32 from escaping through the exhaust collector manifold 37.

Figure 6A:
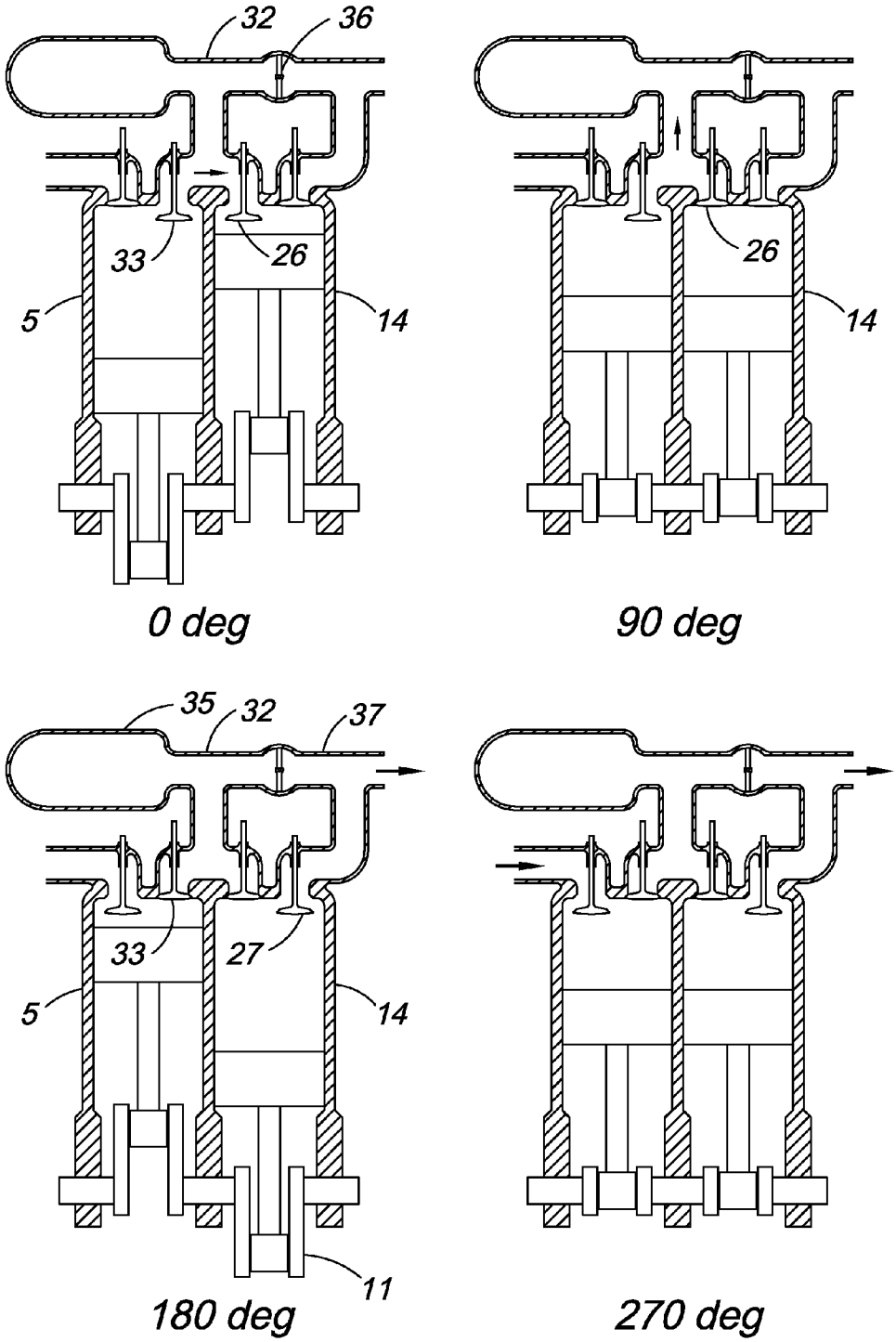
FIG. 6A comprises four side views of a two cylinder embodiment showing sequential motion of the pistons and valves, with compound mode selected, moving from zero through 270 degrees of crankshaft rotation.
Figure 6B:
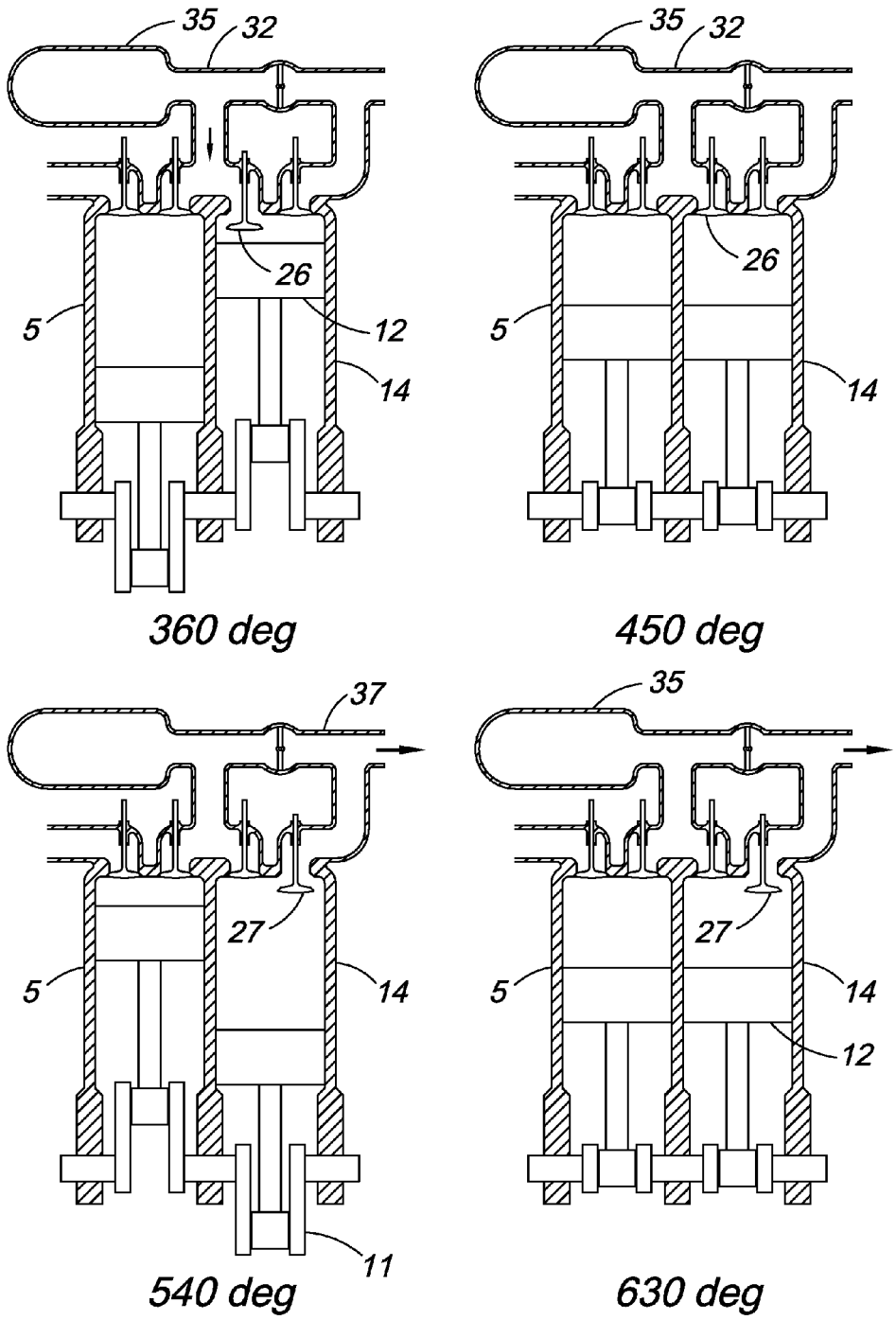
FIG. 6B comprises four additional side views of the same two cylinder embodiment as FIG. 6A, showing sequential motion of the pistons and valves, with compound mode selected, moving from 360 through 630 degrees of crankshaft rotation.

FIG. 6A and FIG. 6B show the compound mode operating sequence of the two cylinder engine embodiment, with compound operating mode selected, in greater detail. For clarity, the continuously closed expansion cylinder intake valve 17 is not shown on FIG. 6A and FIG. 6B, and only one of the two synchronized power cylinder exhaust valves 33 is shown. For further simplification, FIG. 6A and FIG. 6B disregard the effect of gas flow dynamics on valve timing, therefore, the optimum crankshaft position for opening and closing the valves will lead or lag those values presented by FIG. 6A and FIG. 6B to some degree, according to the desired operating speed of the engine and associated gas flow velocities. Referring now to FIG. 6A, at zero degrees crankshaft angle, the power cylinder 5 has completed the power stroke, the power cylinder exhaust valves 33 begin to open and the expansion cylinder first exhaust valve 26 has opened. Between zero and 90 degrees, exhaust gas transfers from the power cylinder 5, through the exhaust manifold 32 to the expansion cylinder 14 through a constant pressure displacement process. At 90 degrees, the first exhaust valve 26 closes. Between 90 and 180 degrees, the gas undergoes isentropic expansion in the expansion cylinder 14, delivering a first increment of work to the crankshaft 11. Meanwhile, the remainder of the exhaust gas transfers from the power cylinder 5 to the exhaust manifold 32 and to the reservoir 35, temporarily raising the pressure of the combustion gas charge through an isentropic compression process. At 180 degrees, the power cylinder exhaust valves 33 close, trapping the exhaust gas charge in the exhaust gas manifold 32 and reservoir 35 under pressure. Meanwhile, the expansion cylinder second exhaust valve 27 opens, allowing the fully expanded gas charge to blow down into the exhaust collector manifold 37. Between 180 and 360 degrees, the power cylinder 5 completes its intake stroke and the expansion cylinder 14 completes its first exhaust stroke. The expansion cylinder second exhaust valve 27 closes when the expansion cylinder piston 12 is a short distance below top dead center, compressing the remaining gas to a pressure approximately equal to the pressure of gas trapped in the exhaust manifold 32 and reservoir 35. As shown on FIG. 6B, at 360 degrees, the expansion cylinder first exhaust valve 26 opens. Since the pressure in the expansion cylinder 14 approximates the pressure in the exhaust manifold 32, no gas energy is wasted by filling the expansion cylinder combustion chamber volume through blow-down of the exhaust manifold 32. Between 360 and 450 degrees, the power cylinder 5 begins its compression stroke and exhaust gas transfers from the reservoir 35 and the exhaust manifold 32 to the expansion cylinder 14, dropping in pressure as it does so. As a result, work which was done on the gas when it was compressed in the power cylinder 5 between 90 and 180 degrees is recovered in the expansion cylinder 14 between 360 and 450 degrees as this same gas charge undergoes initial isentropic expansion in the expansion cylinder 14. At 450 degrees, gas pressure in the exhaust manifold 32 has returned to the same value it was between zero and 90 degrees, and the first exhaust valve 26 closes a second time. Between 450 and 540 degrees, the gas undergoes further isentropic expansion in the expansion cylinder 14, delivering a second increment of work to the crankshaft 11, and meanwhile the power cylinder 5 completes the compression stroke. At 540 degrees, the expansion cylinder second exhaust valve 27 opens, allowing the fully expanded gas charge to blow down into the exhaust collector manifold 37. Between 630 and zero degrees, the expansion cylinder 14 completes its second exhaust stroke and the power cylinder 5 completes its power stroke. As before, the expansion cylinder second exhaust valve 27 closes early prior to the expansion cylinder piston 12 reaching top dead center so that expansion cylinder combustion chamber pressure approximates exhaust gas manifold 32 pressure when the expansion cylinder first exhaust valve 26 opens at zero degrees to repeat the cycle.

Each gas charge thus undergoes four conventional piston strokes in the power cylinder 5 plus four additional piston strokes in the expansion cylinder 14, thereby comprising, in total, an eight stroke cycle over 720 degrees of crankshaft rotation. The first and second expansion cylinder work increments represent work recovered from the combustion gas that would otherwise be wasted by cylinder blow-down when an exhaust valve opens on an engine operating according to the conventional four stroke cycle. In this embodiment, the two isentropic expansion half strokes in the expansion cylinder 14, from 90 degrees to 180 degrees and from 450 degrees to 540 degrees, together comprise a volume equal to the displacement of the power cylinder 5, which effects a doubling of the engine expansion ratio as compared to an equivalent conventional four stroke cycle engine.

Figure 7:
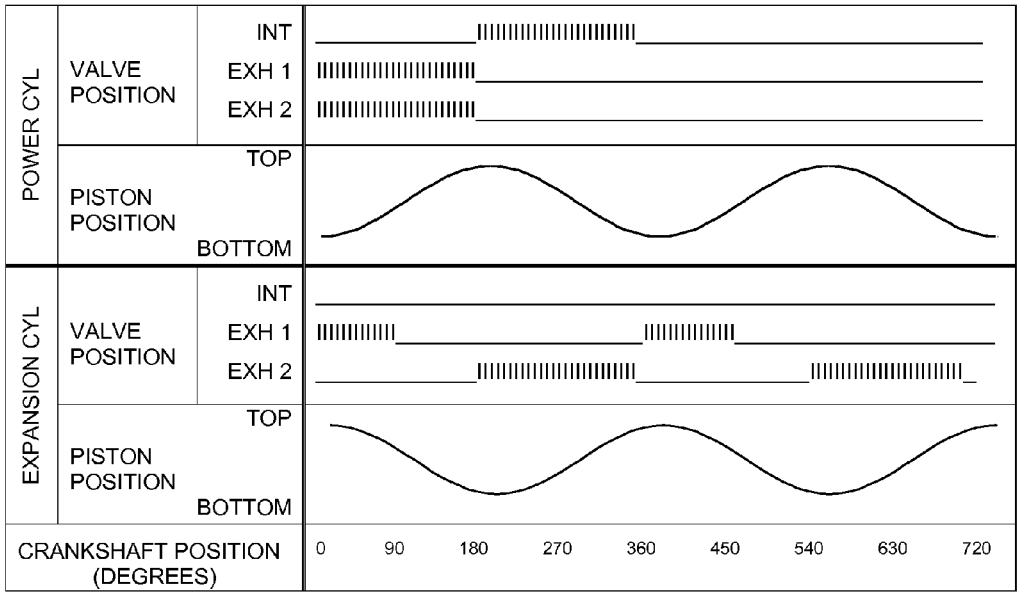
FIG. 7 is a valve timing chart of a two cylinder embodiment operating with compound mode selected.

FIG. 7 shows the timing of the engine valves effected by the profile of the valve cams 6, 7, 25, 28, 29, 30 and 31 for the FIG. 1 two cylinder engine embodiment. FIG. 7 shows that at 180 degrees, there is no opening position overlap between the FIG. 1 power cylinder intake valve cam 6 and power cylinder exhaust valve cams 7 when compound mode is selected. This is required during compound mode operation, because if both the power cylinder intake valve 42 and the power cylinder exhaust valves 33 were to be open at the same time, some of the compressed exhaust gas charge could be lost by reverse flow through the power cylinder exhaust valves 33, through the power cylinder 5 and out the port for the power cylinder intake valve 42. If valve overlap is desired to enhance power output for high engine speed, wide open throttle operation while compound mode is de-selected, a conventional camshaft phase shifting mechanism or a conventional variable cam lift mechanism may be added to modify the timing of the power cylinder intake valve 42, or power cylinder exhaust valves 33, such that power cylinder valve overlap can be de-selected when compound mode is selected.

Referring now back to FIG. 5, although combustion gas pressure in the exhaust manifold 32 varies throughout the engine cycle depending on the sequencing of power cylinder 5 emptying and expansion cylinder 14 filling, exhaust manifold 32 gas pressure during steady state operation with compound mode selected is never less than the pressure of the gas charge in the power cylinder 5 at the end of its power stroke. This aspect of the invention, in which the exhaust manifold 32 and reservoir 35 store a charge of gas from the power cylinder 5, means that the present invention imposes no design constraints on an engine with respect to cylinder-to-cylinder piston stroke timing. As a result, the present invention may be applied to all manner of piston engine cylinder and crankcase configurations, including but not limited to, in-line, vee, opposed and radial configurations, to engines with any number of cylinders, and to engines with any cylinder firing order sequence.

The practical feasibility of the invention may be illustrated by calculating the additional work recovered by doubling the expansion ratio, as illustrated by FIG. 1, for a single operating condition with compound mode selected. In order to simplify the analysis, an air standard cycle with a constant specific heat ratio for air is assumed.

Assumptions:

Air specific heat ratio, $\gamma=1.4$, constant

Air constant volume specific heat coefficient, $C_v=0.171$ BTU/lbmF

Stoichiometric Air to Fuel ratio=14.7

Fuel Lower Heating Value=17,500 BTU/lbm

Sea level standard ambient pressure=14.67 psia

Sea level standard ambient temperature=59 deg F.

Intake throttling pressure drop=4 psig

Volumetric compression ratio, $V_1/V_2=9:1$

Spark ignition at top dead center (Otto cycle)

All fuel burns at top dead center after ignition

Friction work=$w_f$=(0.1)(Indicated work with compound mode de-selected)

Operating States of the Cycle:

0 Ambient

1 Start of compression stroke

2 Top dead center of compression stroke, prior to ignition

3 Top dead center of compression stroke, after ignition

4 Bottom dead center of power cylinder expansion stroke

5 End of expansion cylinder expansion stroke

6 Discharge of exhaust gas from the expansion cylinder

Throttling of the intake charge:

$$P_1=P_0-4=14.67-4=10.67 \text{ psia}$$

$$T_1=T_0=59F=519R$$

Power Cylinder Compression:

$$P_2/P_1=(V_1/V_2)^{\gamma}=9^{1.4}=21.67$$

$$P_2=(P_2/P_1)(P_1)=(21.67)(10.67)=231.3 \text{ psia}$$

$$T_2=T1(V_1/V_2)^{\gamma-1}=519(9)^{(1.4-1)}=1250 \text{ deg R}$$

Ignition and Combustion of the Fuel:

$$q=\text{Fuel Lower Heating Value/Air-Fuel ratio}=17{,}500 \text{ BTU/lbm}/14.7=1190 \text{ BTU/lbm}$$

$$q=Cv(T_3-T_2)=1190 \text{ BTU/lbm}=0.171(T_3-1250R)$$

$$T_3=8209 \text{ deg R}$$

$$P_3/P_2=T_3/T_2=8209/1250=6.57$$

$$P_3=(P_3/P_2)P_2=(6.57)231.3=1519 \text{ psia}$$

Isentropic Expansion in the Power Cylinder:

$$P_3/P_4=(V_4/V_3)^{\gamma=(9)^{1.4}}=21.67$$

$$P_4=P_3/21.67=1519/21.67=70.1 \text{ psia}$$

$$T_3/T_4=(V_4/V_3)^{\gamma-1}=(9)^{0.4}=2.408$$

$$T_4=T_3/2.408=8209/2.408=3408 \text{ deg R}$$

Heat Rejected During the Power Cylinder Cycle:

$${}_4q_1=Cv(T_1-T_4)=0.171(519-3408)=-494 \text{ BTU/lbm}$$

Net Indicated Work Produced During the Power Cylinder Cycle:

$$w_p=1190-494=696 \text{ BTU/lbm}$$

Isentropic Expansion in the Expansion Cylinders:

$$P_4/P_5=(V_5/V_4)^{\gamma}=(2)^{1.4}=2.639$$

$$P_5=P_4/2.639=70.1/2.639=26.6 \text{ psia}=11.9 \text{ psig}$$

Since $P_5$ is above ambient pressure, the exhaust gas was not over-expanded in the expansion cylinder, therefore work was done over the entire expansion interval, despite throttling of the intake charge.

$$T_4/T_5=(V_5/V_4)^{\gamma-1}=(2)^{0.4}=1.320$$

$$T_5=T_4/1.320=3408/1.320=2583 \text{ deg } R=T_6$$

Heat Rejected from the Engine During Both the Power Cylinder and Expansion Cylinder Cycles:

$${}_6q_1=Cv(T_1-T_6)=0.171(519-2583)=-353 \text{ BTU/lbm}$$

Total Net Indicated Work Produced During the Overall Engine Cycle:

$$w_n=q+{}_6q_1=1190-353=837 \text{ BTU/lbm}$$

Work Recovered by the Expansion Cylinder:

$$w_e=w_n-w_p=837-696=141 \text{ BTU/lbm}$$

Work Delivered to the Crankshaft Output Coupling in Non-Compound Mode, Subtracting Friction Work:

$$w_c=w_p-w_f=696-0.1(696)=626 \text{ BTU/lbm}$$

Additional work recovered by the invention in the expansion cylinder when compound mode is selected, as a percentage of the crankshaft output coupling work delivered if compound mode is de-selected:

$$\text{Work recovered}=(w_e/w_c)(100\%)=(141/626)(100\%)=22.5\%$$

When efficiency gains from reduced throttling of an estimated five to ten percent are added to the calculated efficiency gains from increasing expansion ratio, the total engine fuel efficiency gain provided by the invention is: 22.5%+(5% to 10%)=27.5% to 32.5%. This calculated value of fuel efficiency gain is conservative owing to the simplified analysis. On an actual engine, the fuel does not burn instantaneously, instead it burns during a substantial portion of the power cylinder power stroke, resulting in a lower peak cylinder pressure, and consequently a higher exhaust gas charge pressure at the end of the power stroke. Therefore, the gas charge expanded in the expansion cylinder 14 will deliver more work energy than that calculated by this simplified analysis. Although determined by simplified analysis, this calculated engine fuel efficiency gain indicates the practical feasibility and usefulness of the invention.

Figure 8:
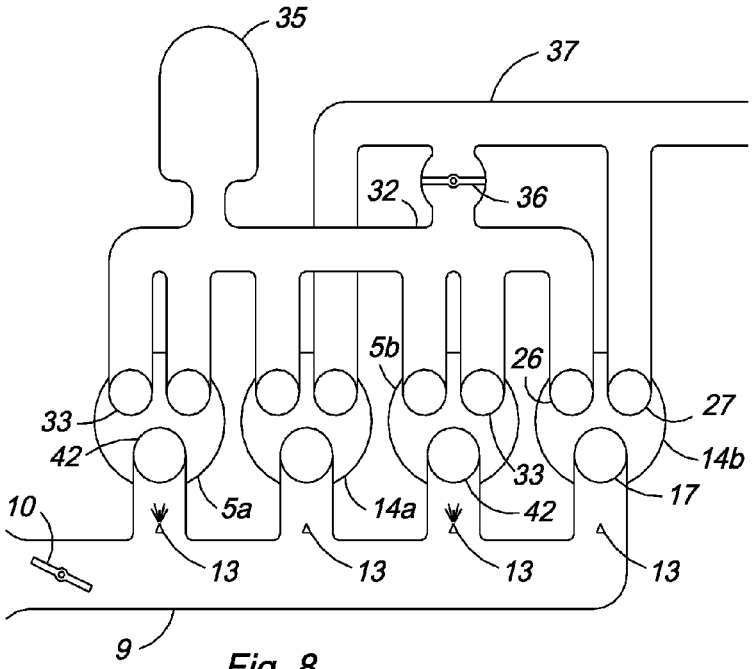
FIG. 8 is a plan view of a four cylinder embodiment operating with compound mode selected.
Figure 9:
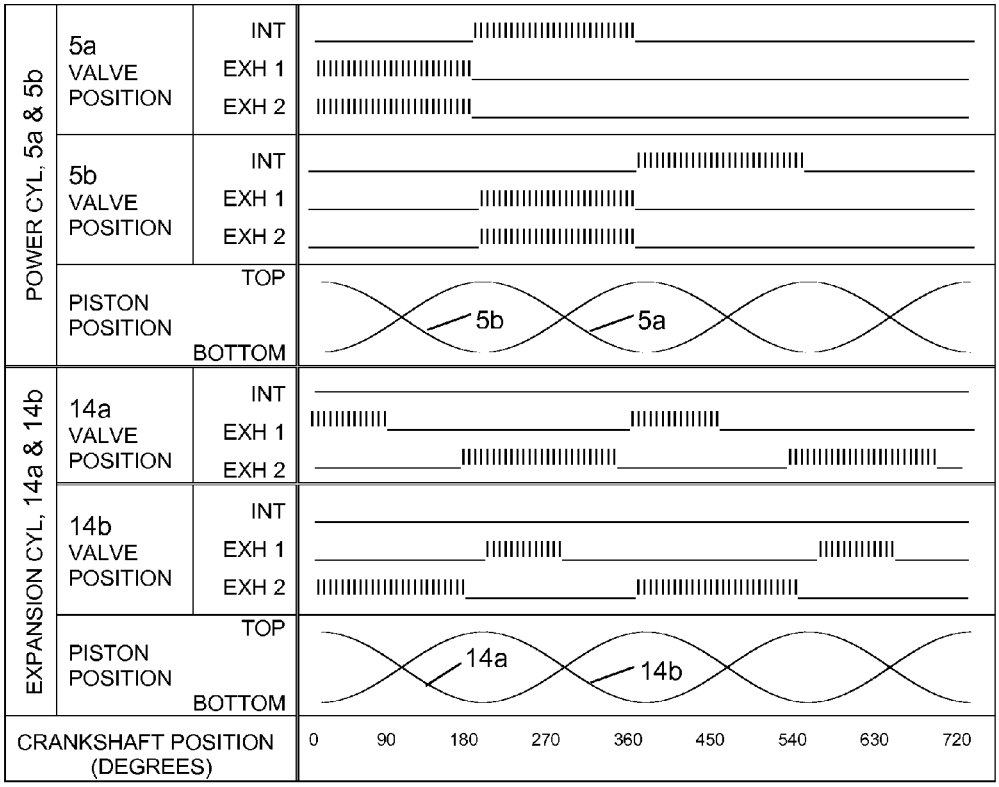
FIG. 9 is a valve timing chart of a four cylinder embodiment operating with compound mode selected.

FIG. 8 shows a four cylinder example of the present invention, illustrating how the present invention can accommodate any number of additional cylinders greater than the two cylinder example of FIG. 1. FIG. 9 shows the timing of the engine valves effected by the profile of the valve cams for a four cylinder engine embodiment in which two cylinders function as power cylinders 5*a* and 5*b*, and the other two cylinders function as selective expansion cylinders 14*a* and 14*b*, thereby providing four expansion cylinder half-stroke work events per 720 degree engine cycle and yielding the same doubling of the engine expansion ratio as the two cylinder example of FIG. 1.

Although these example embodiments describe a doubling of the engine expansion ratio, the subject invention is by no means limited to increasing expansion ratio only by a factor of two. For example, a five cylinder engine can be configured with two power cylinders and three expansion cylinders, thereby yielding an expansion ratio of 5/2=2.5. When the same engine is re-configured with three power cylinders and two expansion cylinders, expansion ratio then becomes 5/3=1.67. Accordingly, the expansion ratio in compound mode may be configured as required to best suit the anticipated operating duty cycle of a specific engine configuration, depending on the overall number of cylinders comprising the engine.

Figure 10:
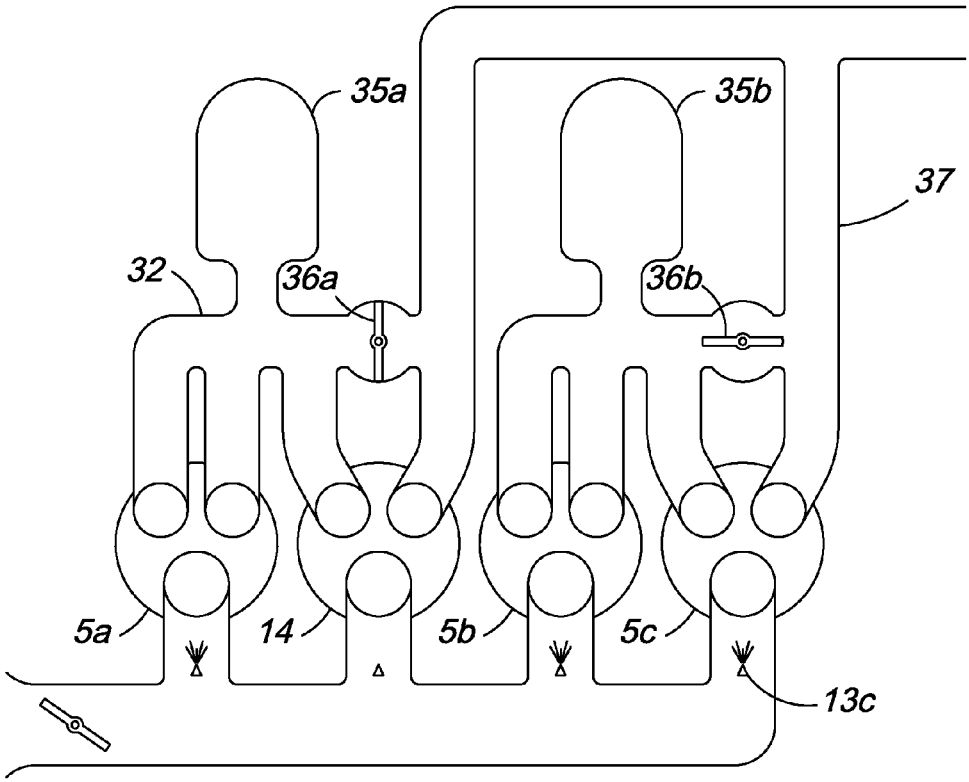
FIG. 10 is a plan view of a four cylinder embodiment configured for two stages of compounding, operating with compound mode selected, and one cylinder functioning as an expansion cylinder.

FIG. 10 shows a four cylinder example of the present invention, illustrating how the present invention can accommodate multiple stages of selective compound operation in which one or more expansion cylinders are selected incrementally according to how much power is being demanded from the engine. Such progressive selection of the degree of compounding allows compounding to be useful over a wider range of engine power output than would be the case if only one stage of compounding is provided. Two stages of compounding may be obtained by configuring two exhaust gas diverter valves 36 and two exhaust gas reservoirs 35 in the exhaust manifold 32 as shown by FIG. 10. Engines with more than four cylinders can accommodate three or more exhaust gas diverter valves and three or more exhaust gas reservoirs, thereby further widening the useful power range that can be accommodated by selective compounding.

Figure 11:
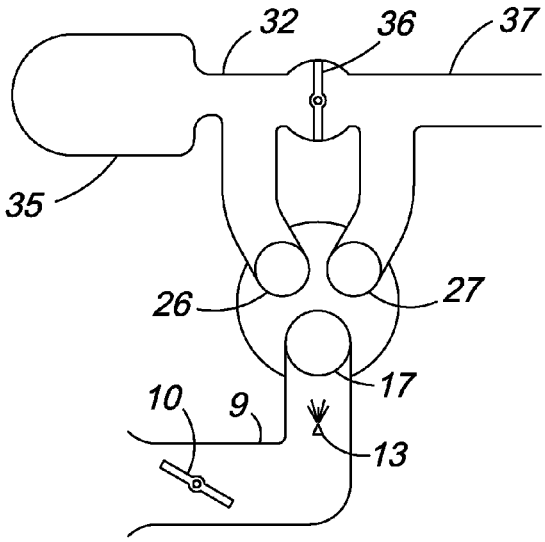
FIG. 11 is a plan view of a one cylinder embodiment operating with compound mode selected.
Figure 12:
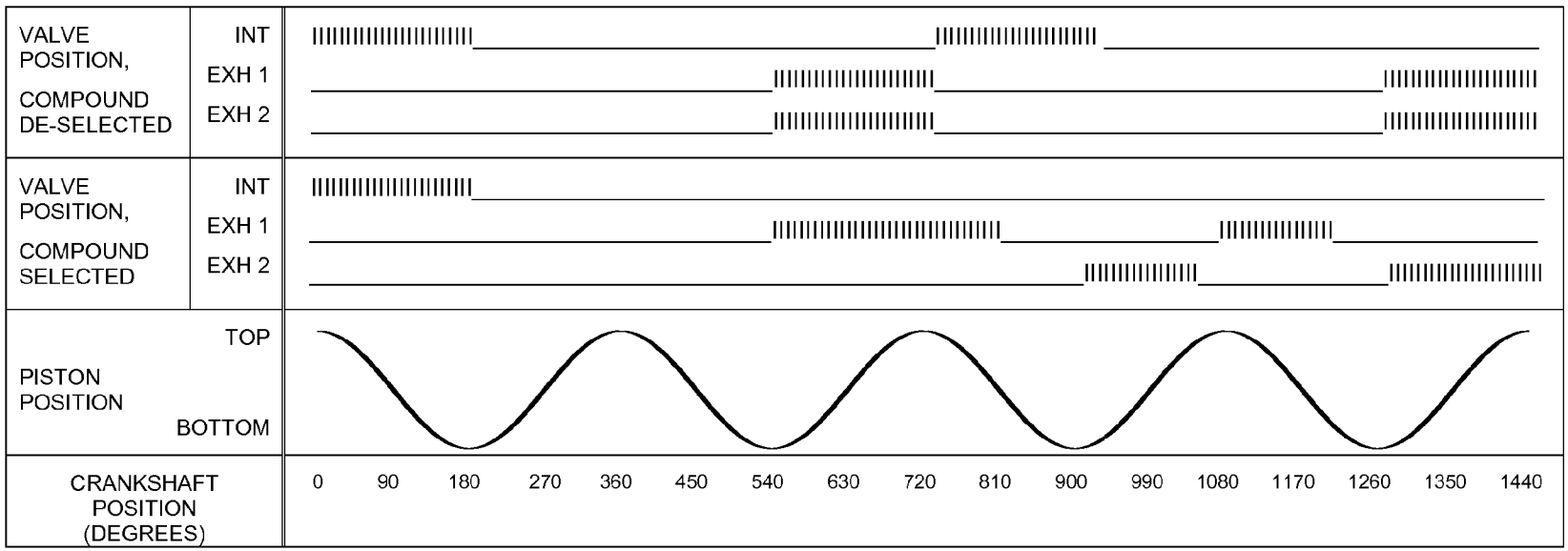
FIG. 12 is a valve timing chart of a one cylinder embodiment operating with compound mode selected.

FIG. 11 shows how a single cylinder engine can be configured for selective compounding, by means of a single cylinder configured to alternate function between that of power cylinder and that of expansion cylinder, when compound operating mode is selected. Single cylinder compounding requires that the intake valve have two cams instead of one, and that the second exhaust valve 27 have two dis-engageable couplings instead of one. The camshaft rotates at one fourth crankshaft speed, according to an eight stroke cycle, over 1440 degrees of crankshaft revolution per cycle. Accordingly, each of the four exhaust valve cams has two lobes. When either sequential or direct fuel injection is used, the timing of the fuel injection events changes from one injection event every two crankshaft revolutions when compound mode is de-selected to one injection event every four crankshaft revolutions when compound mode is selected. FIG. 12 is a valve timing diagram which shows that, during the exhaust stroke following the power stroke, all of the exhaust gas charge is compressed and stored in the exhaust gas reservoir chamber 35, subsequently the following two expansion strokes deliver one increment of work each to the crankshaft 11. Because initial pressure at the beginning of the first expansion stroke is higher than it is for the beginning of the second expansion stroke, the first exhaust valve 26 is timed to open prior to the piston reaching midstroke position for the first expansion stroke and opens after the piston reaches midstroke for the second expansion stroke. This produces an expansion ratio for the first stroke greater than two and an expansion ratio for the second stroke less than two, which makes the cylinder pressure at the end of both expansion strokes equal, thus minimizing blow-down losses at the end of both expansion strokes. The total swept volume for the two expansion cylinder half-strokes equals the total swept volume of the cylinder when it is acting as a power cylinder, which effectively doubles the engine expansion ratio as compared to operation in four stroke cycle mode when compound operating mode is de-selected. The cylinder configuration shown on FIG. 11 may be applied to individual cylinders of a multiple cylinder engine in order to effect multiple stages of selective compounding, thereby widening the engine power output range over which compounding is useful, yielding a benefit similar to that provided by the alternate configuration shown by FIG. 10.

Figure 13:
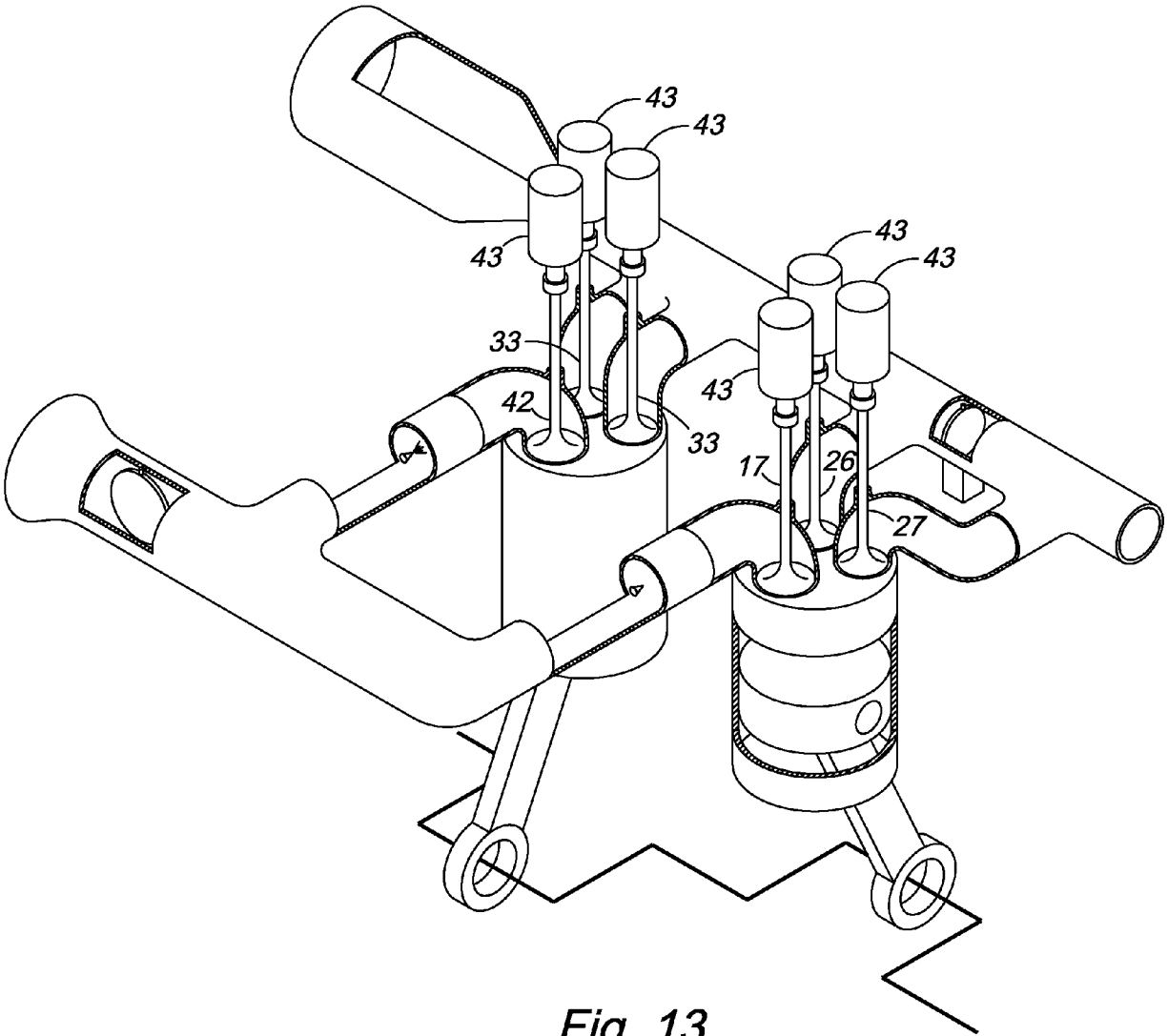
FIG. 13 is a comprehensive isometric view of all relevant elements of a two cylinder embodiment of the invention configured with powered actuators to move the cylinder port valves instead of rotable shaft driven cams and drive cam couplings.

FIG. 13 shows that the intake and exhaust valves, 17, 42, 33, 26 and 27, may be directly actuated by hydraulic or electromechanical actuators 43 instead of by conventional camshafts, cams, cam follower levers and dis-engageable couplings, while providing all of the variable valve timing characteristics shown by FIG. 1. The advantage of hydraulic or electromechanical valve actuation is reduction of mechanical complexity by elimination of the camshafts, camshaft drive mechanisms, cam followers and dis-engageable couplings. This advantage trades off against the disadvantage of the cost and weight of electronic or hydraulic power supplies and associated controls for the valve actuators 43.

Many modifications and other embodiments of the subject invention will come to mind to one skilled in the art to which this invention pertains, having the benefit of the teachings presented in the foregoing descriptions and the associated drawings. Therefore, it is to be understood that the invention is not to be limited to the specific embodiments disclosed, and that modifications and other embodiments are intended to be included within the scope of the appended claims.

That which is claimed is:

1. A fuel burning, internal combustion, reciprocating piston engine, comprising in combination, two cylinders, one piston coaxially reciprocating within each cylinder, said pistons each linked by a connecting rod to a common rotable crankshaft, said crankshaft possessing a rotable output coupling to which a driven load may be connected, and further comprising in combination;

(a) a first, fuel burning fired cylinder operating according to a four stroke cycle;

(b) a second, selective expansion cylinder provided with means to alter its function back and forth, while said engine is running, from that of a fuel burning fired cylinder to that of a compound exhaust gas expansion cylinder, thereby effecting a secondary expansion of combustion gas transferred from said fired cylinder to said expansion cylinder within the span of one engine cycle;

(c) said selective expansion cylinder provided with an intake valve with open and closed positions;

(d) said selective expansion cylinder also provided with a first exhaust valve with open and closed positions;

(e) said selective expansion cylinder also provided with a second exhaust valve with open and closed positions;

(f) two combustion gas ports connecting a separate combustion gas conduit to each exhaust valve of said selective expansion cylinder;

(g) an exhaust gas manifold diverter valve with open and closed positions;

(h) means to actuate said exhaust gas manifold diverter valve open or closed such as, but not limited to, air bellows, hydraulic piston and cylinder, electric solenoid or electric motor;

(i) an exhaust gas reservoir chamber;

(j) an exhaust gas manifold possessing a plurality of conduits, separately connecting to each exhaust valve port for said selective expansion cylinder and to the exhaust port or ports of said fired cylinder, said gas conduits also connecting to said exhaust gas manifold diverter valve and to said exhaust gas reservoir chamber, said gas conduits further connecting to an exhaust gas discharge outlet;

(k) said selective expansion cylinder also provided with a rotable shaft driven cam, said cam having a lobe to actuate said intake valve for said selective expansion cylinder, driven by said crankshaft, rotating at one half crankshaft speed;

(l) said selective expansion cylinder also provided with first and second rotable shaft driven cams, each said cam having a lobe or lobes to actuate said first exhaust valve for said selective expansion cylinder, driven by said crankshaft, rotating at one half crankshaft speed, said first cam having one lobe shaped to urge said first exhaust valve open once every two crankshaft revolutions, thereby evacuating combustion exhaust gas from said cylinder according to a four stroke cycle, and said second cam having two lobes shaped to urge said first exhaust valve open once for each crankshaft revolution, thereby admitting combustion exhaust gas from said combustion exhaust manifold into said selective expansion cylinder once for each crankshaft revolution;

(m) said selective expansion cylinder also provided with third and fourth rotable shaft driven cams, each said cam having a lobe shaped to actuate said second exhaust valve for said selective expansion cylinder, driven by said crankshaft, rotating at one half crankshaft speed, said third cam having one lobe shaped to urge said second exhaust valve open to evacuate gas from said selective expansion cylinder once every two crankshaft revolutions according to a four stroke cycle, and said fourth cam having one lobe clocked 180 degrees with respect to said third cam shaped to to enable said third and fourth cams in combination to urge said second exhaust valve open once for each crankshaft revolution, thereby evacuating gas from said selective expansion cylinder once for each crankshaft revolution;

(n) said selective expansion cylinder also provided with a dis-engageable coupling interposed between said intake valve and said intake valve drive cam of said selective expansion cylinder that, when selected, decouples said intake valve cam from said intake valve, whereby said intake valve remains closed, and when deselected, couples said intake valve cam and said intake valve, thereby urging said intake valve open and closed according to a four stroke cycle;

(o) said selective expansion cylinder also provided with a paired set of disengageable couplings, interposed between said first exhaust valve and said first and second drive cams of said selective expansion cylinder that, when selected, decouples said first drive cam from said first exhaust valve and couples said second drive cam with said first exhaust valve, said second drive cam thereby urging said second exhaust valve open once every crankshaft revolution, thereby admitting combustion exhaust gas from said exhaust gas manifold into said expansion cylinder once for each crankshaft revolution, and when deselected, decouples said second drive cam from said first exhaust valve and couples said first drive cam with said first exhaust valve, said first drive cam thereby urging said first exhaust valve open once every other crankshaft revolution, thereby evacuating combustion exhaust gas from said selective expansion cylinder according to a four stroke cycle;

(p) said selective expansion cylinder also provided with a dis-engageable coupling interposed between said second exhaust valve and said fourth drive cam that, when selected, couples said second exhaust valve with said fourth drive cam, whereby, said fourth drive cam in combination with said third drive cam, together urge said second exhaust valve open once every crankshaft revolution, so as to evacuate combustion exhaust gas from said selective expansion cylinder once every crankshaft revolution, and when deselected, de-couples second exhaust valve from said fourth drive cam, whereby said third drive cam urges said second exhaust valve open once every two crankshaft revolutions to evacuate combustion exhaust gas from said selective expansion cylinder according to a four stroke cycle;

(q) said selective expansion cylinder also provided with actuation means to select and de-select said dis-engageable couplings, such as, but not limited to, hydraulic piston and cylinder, electric solenoid or electric motor;

(r) control means which, while said engine is running, automatically selects said compound mode exhaust gas expansion function when moderate engine power is required, and de-selects said compound mode exhaust gas expansion function when high engine power is required or when smooth engine operation at very low power settings or at idling speed is required, and;

(s) control connections between said control means and the engine fuel system, exhaust gas manifold diverter valve and drive cam couplings, which conduct compound mode selective commands from said control means to shut off fuel supply to said selective expansion cylinder, if said engine is configured to deliver fuel to each cylinder individually, select said intake valve dis-engageable coupling, select said first exhaust valve paired set of dis-engageable couplings, select said second exhaust valve dis-engageable coupling, and close said exhaust gas manifold diverter valve, whereby said selective expansion cylinder functions in compound exhaust gas expansion mode, and alternatively, which conduct compound mode de-selective commands from said control means to deselect said intake valve dis-engageable coupling, deselect said first exhaust valve pair of dis-engageable couplings, deselect said second exhaust valve dis-engageable coupling, open said exhaust gas manifold diverter valve, and resume fuel supply to said expansion cylinder if said engine is configured to deliver fuel to each cylinder individually, such that both engine cylinders operate as fuel burning fired cylinders according to a four stroke cycle, whereby, said engine fuel efficiency increases after selecting said compound operating mode, and said engine power capacity maximizes after deselecting said compound operating mode.

2. The engine of claim 1, further comprising:

(a) one or more additional cylinders, with one or more cylinders provided with means to select the function of said cylinder or cylinders back and forth, while said engine is running, from that of a conventional fuel burning fired cylinder or cylinders to that of an expansion cylinder or cylinders, thereby effecting a secondary expansion of combustion gas transferred from one or more fired cylinders, all cylinders sharing the same crankshaft, (b) a common exhaust gas manifold possessing a plurality of conduits, separately connecting to each exhaust valve port for each said selective expansion cylinder and to the exhaust port or ports of each said fired cylinder, said gas conduits also connecting to said exhaust gas manifold diverter valve and to said exhaust gas reservoir chamber, said gas conduits further connecting to an exhaust gas discharge outlet.

3. The engine of claim 2, further comprising:

(a) two or more exhaust gas manifold diverter valves and a like number of exhaust gas reservoir chambers, said exhaust gas manifold possessing a plurality of conduits connecting to said exhaust manifold diverter valves and exhaust gas reservoir chambers, and said automatic control means provided with means to progressively select one or more compound exhaust gas expansion cylinders in two or more sequenced stages, while said engine is running, according to the amount of power demanded from the engine.

4. The engine of claim 2, comprising:

electromechanical or hydro-mechanical servomechanisms directly actuating intake and exhaust valves according to an opening and closing schedule programmed into an automatic controller instead of actuating said valves by rotable shaft driven cams and associated drive cam couplings.

5. The engine of claim 3, comprising:

electromechanical or hydro-mechanical servomechanisms directly actuating intake and exhaust valves according to an opening and closing schedule programmed into an automatic controller instead of actuating said valves by rotable shaft driven cams and associated drive cam couplings.

6. The engine of claim 1, comprising:

electromechanical or hydro-mechanical servomechanisms directly actuating intake and exhaust valves according to an opening and closing schedule programmed into an automatic controller instead of actuating said valves by rotable shaft driven cams and associated drive cam couplings, whereby, said engine fuel efficiency increases after selecting said selective expansion cylinder to function in said compound exhaust gas expansion mode, said engine power capacity maximizes after deselecting said compound exhaust gas expansion mode, and said engine mechanical complexity substantially decreases.

7. A fuel burning, internal combustion, reciprocating piston engine comprising in combination, a single cylinder or multiple independent cylinders, one piston coaxially reciprocating within each said cylinder, said pistons each linked by a connecting rod to a common rotable crankshaft, said crankshaft possessing a rotable output coupling to which a driven load may be connected, each said cylinder which, when compound mode is selected, alternates function between that of a fired cylinder and that of an expansion cylinder, while said engine is running, once for each eight stroke operating cycle, and further comprising in combination;

(a) each said cylinder provided with an intake valve with open and closed positions, (b) each said cylinder provided with a first exhaust valve with open and closed positions, (c) each said cylinder provided with a second exhaust valve with open and closed positions, (d) each said cylinder provided with two combustion gas ports connecting a separate combustion gas conduit to each exhaust valve of said cylinder;

(e) an exhaust gas manifold diverter valve with open and closed positions;

(f) means to actuate said exhaust gas manifold diverter valve open or closed, such as, but not limited to, air bellows, hydraulic piston and cylinder, electric solenoid or electric motor;

(g) an exhaust gas reservoir chamber;

(h) an exhaust gas manifold possessing a plurality of conduits, separately connecting to each exhaust valve port for said cylinder, said gas conduits also connecting to said exhaust gas manifold diverter valve and said exhaust gas reservoir chamber, said gas conduits further connecting to an exhaust gas discharge outlet;

(i) each said cylinder provided with first and second rotable shaft driven cams having lobes to actuate said intake valve for said cylinder, driven by said crankshaft, both said cams rotating at one fourth crankshaft speed, said first cam having one lobe shaped to urge said intake valve open once every fourth crankshaft revolution and said second cam having one lobe clocked 180 degrees with respect to said first cam, shaped to urge said intake valve open a second time every fourth crankshaft revolution, whereby a fresh gas charge enters said cylinder each time said intake valve opens;

(j) each said cylinder also provided with a dis-engageable coupling interposed between said intake valve and said second intake valve drive cam of said cylinder that, when selected, decouples said second intake valve drive cam from said intake valve, whereby said first intake valve drive cam urges said intake valve open once every four crankshaft revolutions according to an eight stroke cycle and, when deselected, couples said second intake valve drive cam with said intake valve, whereby said first intake valve drive cam and said second intake valve drive cam in combination urge said intake valve open once every two crankshaft revolutions according to a four stroke cycle:

(k) each said cylinder also provided with first and second rotable shaft driven cams having lobes to actuate said first exhaust valve for said cylinder, driven by said crankshaft, said cams rotating at one fourth crankshaft speed, said first cam having two lobes shaped to urge said first exhaust valve open so as to evacuate gas from said cylinder once every two crankshaft revolutions according to a four stroke cycle; and said second cam having two lobes shaped to urge said first exhaust valve open twice for every four crankshaft revolutions, thereby moving combusted gas to and from said exhaust gas reservoir chamber according to an eight stroke cycle;

(l) each said cylinder also provided with third and fourth rotable shaft driven cams having lobes to actuate said second exhaust valve for said cylinder, driven by said crankshaft, rotating at one fourth crankshaft speed, said third cam having two lobes shaped to urge said second exhaust valve open so as to evacuate gas from said cylinder once every other crankshaft revolution according to a four stroke cycle; and said fourth cam having two lobes shaped to urge said second exhaust valve open twice for every four crankshaft revolutions so as to evacuate gas from said cylinder according to an eight stroke cycle;

(m) each said cylinder also provided with a paired set of dis-engageable couplings interposed between said first exhaust valve and said first and second drive cams of said cylinder that when selected decouples said first drive cam and couples said first exhaust valve with said second drive cam, thereby urging said first exhaust valve open twice every four crankshaft revolutions so as to move combustion exhaust gas to and from said exhaust gas reservoir chamber according to an eight stroke cycle, and when deselected decouples said second drive cam and couples said first exhaust valve with said first drive cam, thereby urging said first exhaust valve open once every two crankshaft revolutions so as to evacuate combustion exhaust gas from said cylinder according to a four stroke cycle;

(n) each said cylinder also provided with a paired set of dis-engageable couplings interposed between said second exhaust valve and said third and fourth drive cams of said cylinder that when selected decouples said third drive cam and couples said second exhaust valve with said fourth drive cam, thereby urging said second exhaust valve open twice every four crankshaft revolutions to evacuate combustion exhaust gas from said cylinder according to an eight stroke cycle, and when deselected decouples said fourth drive cam and couples said second exhaust valve with said third drive cam, thereby urging said second exhaust valve open once every two crankshaft revolutions so as to evacuate combustion exhaust gas from said cylinder according to a four stroke cycle;

(o) control means which automatically selects said secondary exhaust gas expansion function when moderate engine power is demanded, and deselects said secondary exhaust gas expansion function when high engine power is demanded or when smooth engine operation at very low power settings or at idling speed is desired, (p) control means to selectively alter the sequence of fuel delivery to said cylinder back and forth according to the opening sequence of said intake valve so that fuel is delivered to said cylinder once every four crankshaft revolutions when compound operating mode is selected, and is delivered to said cylinder once every two crankshaft revolutions according to a four stroke cycle operating mode when compound operating mode is deselected, and;

(q) control connections between said control means and the engine fuel system, said exhaust gas manifold diverter valve and said dis-engageable couplings, which conduct compound mode selective commands from said control means to admit fuel to said cylinder, select said dis-engageable couplings, and close said exhaust gas manifold diverter valve, such that said cylinder functions in compound exhaust gas expansion mode, and alternatively, which conduct compound mode de-selective commands from said control means to admit fuel to said cylinder, deselect said valve dis-engageable couplings, open said exhaust gas manifold diverter valve, such that said cylinder functions according to a four stroke cycle;

whereby, fuel efficiency provided by said individual cylinder increases after selecting said compound operating mode, independently from other cylinders, and said individual cylinder power capacity maximizes after deselecting said compound operating mode.

8. The engine of claim 7, comprising:

electromechanical or hydro-mechanical servomechanisms directly actuating intake and exhaust valves according to an opening and closing schedule programmed into an automatic controller instead of actuating said valves by rotable shaft driven cams and associated drive cam couplings, whereby, fuel efficiency of said individual cylinder increases when selecting said compound operating mode, independently from other cylinders, power capacity of said individual cylinder maximizes when deselecting said compound operating mode, and said engine mechanical complexity substantially decreases.

* * * * *